United States Patent [19]

Kramer

[11] Patent Number: 4,569,661

[45] Date of Patent: Feb. 11, 1986

[54] FURNACE CONSTRUCTION

[75] Inventor: Larry J. Kramer, Lyndhurst, Ohio

[73] Assignee: General Electric Company, Schenectady, N.Y.

[21] Appl. No.: 646,678

[22] Filed: Sep. 4, 1984

[51] Int. Cl.[4] ..... F27D 5/00; F27B 9/00; F26B 25/10

[52] U.S. Cl. ..... 432/253; 34/237; 432/121; 432/258

[58] Field of Search ..... 432/121, 126, 253, 258; 34/192, 237

[56] References Cited

U.S. PATENT DOCUMENTS

| | | | |
|---|---|---|---|
| 1,546,382 | 7/1925 | Higgins | 432/258 |
| 3,261,110 | 7/1966 | Fuentevilla | 34/237 |
| 4,177,035 | 12/1979 | Buschermohle | 432/121 |
| 4,218,214 | 8/1980 | Nelson | 432/258 |
| 4,458,815 | 7/1984 | Mollman et al. | 34/237 |

FOREIGN PATENT DOCUMENTS

| | | | |
|---|---|---|---|
| 1452652 | 10/1976 | United Kingdom | 432/121 |
| 710620 | 1/1980 | U.S.S.R. | 432/253 |

*Primary Examiner*—John J. Camby

*Attorney, Agent, or Firm*—J. F. McDevitt; Philip L. Schlamp; Fred Jacob

[57] ABSTRACT

An improved furnace construction is provided permitting ceramic materials of various types to be processed at significantly elevated temperatures or being transported to the furnace enclosure. More particularly, novel transport means are provided for said ceramic materials to avoid problems with thermal shock and chemical attack here and for encountered during such processing of the ceramic materials. The novel transport means includes a furnace tray construction for the ceramic materials exhibiting greater abrasion resistance at the elevated furnace operating temperatures and which preferably cooperates with a hearth member in said furnace construction having comparable abrasion resistance.

5 Claims, 2 Drawing Figures

FURNACE CONSTRUCTION

BACKGROUND OF THE INVENTION

This invention relates generally to a furnace construction adapted for heating ceramic materials to significantly elevated temperatures wherein these materials are either sintered or otherwise reacted to form a wide variety of final products, such as phosphors, wear parts and the like. At elevated temperatures of 1000° C. and above which are typically encountered in such type furnaces, the furnace construction itself is susceptible to both thermal shock and chemical attack occasioned by significant volatilization of the ceramic materials being processed. Such problems are especially aggravated in those furnaces requiring that the ceramic materials be moved during processing which can further cause serious physical abrasion to the ceramic materials and furnace parts being moved. Abraded material often combines with by products of the chemical reaction to form accummulations in the heated enclosure of the furnace, thereafter obstructing further movement of the ceramic materials through said heated enclosure.

The extent and seriousness of this general problem can be illustrated in the preparation of inorganic phosphors at temperatures often exceeding 1150° C. in tunnel-type furnaces. Containers such as quartz trays or crucibles are filled with the phosphor powder and placed on plate-like ceramic tray members which now include opposing runner surfaces extending from one major surface of the individual tray members. The loaded trays are then transported by conveyor means to the furnace heated enclosure and pushed across a ceramic hearth member of the heated enclosure during the firing operation. While the known ceramic tray material itself, generally cordierite, exhibits satisfactory resistance to thermal shock and chemical attack when subjected to these elevated temperatures, the presence of a phosphor material produces a far different result. Specifically, phosphor volatilization products such as antimony and water vapor combine with the abraded material formed when the tray runners move across the furnace hearth surface to produce a glassy accummulation obstructing further passage of the loaded trays through the furnace. The furnace is thereafter required to be shut down to remove the obstructing accummulation or replace furnace parts in order to again permit tray movement through the furnace.

It would be desirable, therefore, to modify such furnace contructions so as to better resist the effects of physical abrasion occuring therein. It would further be desirable to do so with relatively modest structural changes in the furnace construction and which do not significantly alter the manufacturing operations.

SUMMARY OF THE INVENTION

It is now been discovered that all of the aforementioned objectives are achieved with a furnace tray construction providing increased abrasion resistance at the elevated furnace operating temperatures and which comprises a plate-like ceramic member with opposing runner surfaces extending from one major surface of said member with said runner surfaces further including portions of a more abrasion resistant ceramic material which project from said runner surfaces. More particularly, the runner surfaces are kept from physical contact with the hearth surface of the furnace heated enclosure by means of elements formed with a more abrasion resistant ceramic which protrude outwardly from said surfaces. Said protruding elements can be provided with inserts cemented into spaced apart openings located on the runner surfaces with a ceramic cement. Silicon carbide inserts can be used for this purpose as can pads of various other ceramic materials including alumina and a commercially available infiltrated silicon-silicon carbide composite ceramic which all exhibit superior abrasion resistance at the furnace operating temperatures as compared with the cordierite ceramic material now employed to form the above described plate-like ceramic tray member.

An improved furnace construction according to the present invention thereby includes a heated enclosure through which ceramic materials are moved in trays while being heated and with said trays being supported on a hearth member in said heated enclosure, wherein said trays exhibit increased abrasion resistance attributable to construction as a plate-like ceramic member with opposing runner surfaces extending from one major surface of said member and with said runner surfaces further including portions of a more abrasion resistant ceramic projecting from said runner surfaces than the material being used to form said hearth member. Still further extension of the furnace operating time period can be obtained by matching the abrasion resistance of the present tray appurtances to the abrasion resistance of the ceramic material used to form the furnace hearth member. More particularly, it has been found that protruding inserts for the runner surfaces made of silicon carbide which physically contact a silicon carbide hearth member for sliding engagement therewith during heating of the tray contents can maximize the wear life of both members and often avoid replacing hearth member components when the furnace is being overhauled. A preferred furnace embodiment operating in this manner can further include conventional conveyor means located at the entrance and the exit openings of the furnace heated enclosure that still further cooperate with conventional hydraulic ram means to automatically push a plurality of loaded tray members through the heated enclosure. A furnace construction having this configuration essentially avoids any residues being formed on any of the supporting surfaces which can interfere with tray member movement. To illustrate the type of residue buildup which otherwise occurs in thermal processing of calcium haloapatite lamp phosphors, a glassy residue is formed as a high temperature reaction product between iron powder from the furnace conveyor system, cordierite material from the furnace tray members and volitilized antimony from the phosphor material being processed.

DESCRIPTION OF THE PREFERRED EMBODIMENTS

Figure 1:
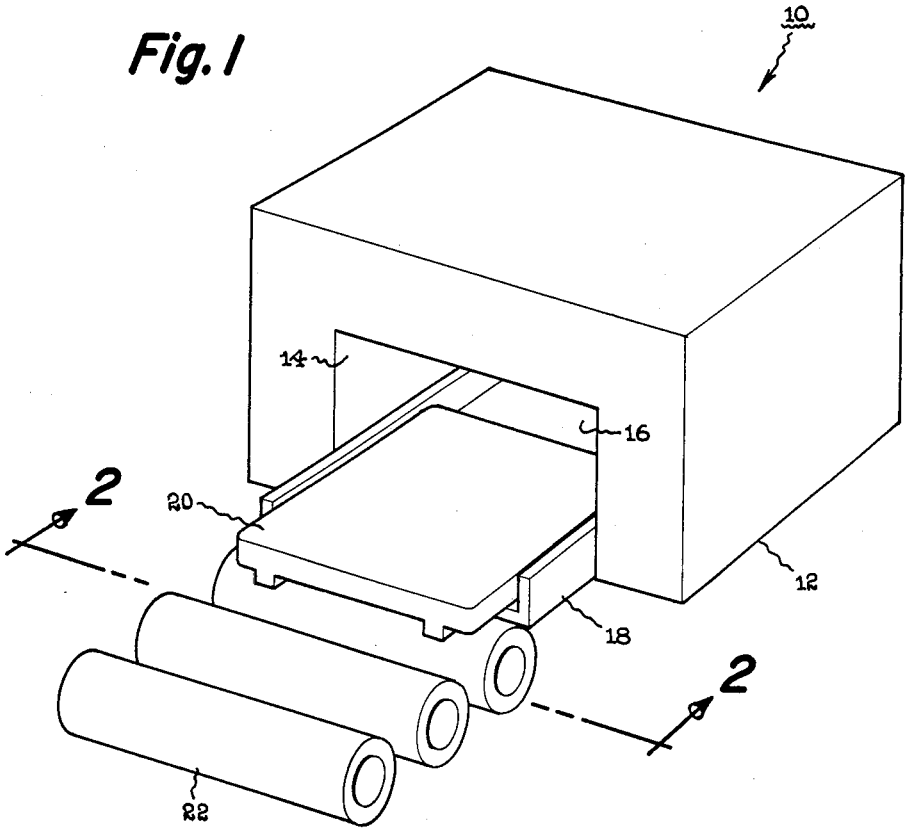
FIG. 1 is a perspective view depicting a furnace construction of the present invention.

Referring to FIG. 1, there is shown a furnace apparatus 10 of the present invention having a generally tunnel like configuration 12 which further includes an internal heated enclosure 14 to which access is gained by an entrance opening 16 provided in said furnace construction. A hearth floor member 18 in said heated enclosure is shown together with a tray member 20 physically being supported on said hearth member and with said tray member including the wear resistant runner surfaces according to the present invention. A conventional conveyor system 22 is also shown to transport the tray member to the heated enclosure and which can further include an automatically operated ram assembly (not shown) to assist in said effort.

Figure 2:
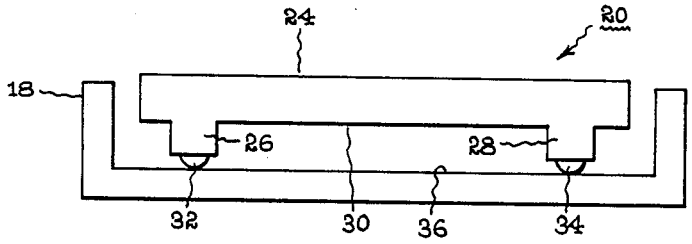
FIG. 2 is a cross-sectional view depicting in greater detail the furnace tray and hearth member construction employed in the FIG. 1 furnace embodiment.

Improved tray member 20 according to the present invention is depicted in FIG. 2 along with the hearth floor member 18 which supports the tray during its movement through the furnace heated enclosure. Specifically, said tray member includes a plate-like ceramic member 24 having a pair of opposing runner surfaces 26 and 28 which extend downwardly from one major surface 30 of the plate-like member to provide a physical support exhibiting minimal friction engagement with the hearth floor surface. As can be noted from the drawing, each of said runner surfaces includes portions 32 and 34, respectively, of a more abrasion resistant ceramic material which project from said runner surfaces to provide the actual physical engagement of the tray member with hearth floor surface 36. An illustrative embodiment for said contacting runner surfaces can be silicon carbide inserts which are adhesively bonded to said runner surfaces with a ceramic cement for a tray like member formed with cordierite ceramic and which is moved along a silicon carbide hearth floor warming member in the described furnace embodiment. In said illustrated furnace construction, it can be further noted that the material of construction used for the hearth member has been selected to have abrasion resistance comparable to the contacting surfaces 32 and 34 of the tray member at the furnace operating temperatures. The operation of said furnace construction in the processing of haloapatite phosphor at 1050° C. produced no visible wear of the tray inserts and hearth floor surface after five trials.

It will be apparent from the foregoing description that an improved furnace construction has been provided having generally utility in the processing of ceramic materials at elevated temperatures of 1000° C. and higher. It will be further evident that modifications can be made in said furnace construction other than above specifically described without departing from the spirit and scope of the present invention. For example, still other abrasion resistant ceramic contact materials can be used for this ceramic tray member other than above specifically disclosed depending on the material of construction employed to fabricate the furnace hearth. Accordingly, it is intended to limit the present invention only by the scope of the following claims.

I claim:

1. A phosphor preparation furnace tray construction exhibiting increased abrasion resistance when exposed to elevated temperature conditions which comprises a plate-like ceramic member with opposing sliding runner surfaces extending from one major surface of said member and with said runner surfaces further including openings and with said openings containing inserts of a more abrasion resistant ceramic projecting from said runner surfaces and adhesively bonded in said openings with a ceramic cement.

2. A tray construction as in claim 1 wherein a plurality of inserts project from each runner surface.

3. A tray construction as in claim 1 wherein the ceramic member is formed with cordierite ceramic.

4. A tray construction as in claim 1 wherein the ceramic inserts are formed with silicon carbide ceramic.

5. A tray construction as in claim 1 wherein the ceramic members is formed with cordierite ceramic and the inserts are formed with silicon carbide ceramic.

* * * * *